US007600830B2

(12) United States Patent
Oh et al.

(10) Patent No.: US 7,600,830 B2
(45) **Date of Patent: *Oct. 13, 2009**

(54) REFRIGERATOR HAVING BASKET LIFT APPARATUS

(75) Inventors: Seung-Hwan Oh, Gyeonggi-Do (KR); Kyung-Han Jeong, Seoul (KR); Sang-Oh Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 583 days.

This patent is subject to a terminal disclaimer.

(21) Appl. No.: 11/024,818

(22) Filed: Dec. 30, 2004

(65) Prior Publication Data

US 2006/0042302 A1 Mar. 2, 2006

(30) Foreign Application Priority Data

Aug. 26, 2004 (KR) ..... 10-2004-0067607

(51) Int. Cl.
*A47B 96/04* (2006.01)
*A47B 95/02* (2006.01)

(52) U.S. Cl. ..... 312/404; 312/402; 312/319.5

(58) Field of Classification Search ..... 312/404, 312/401, 400, 402, 330.1, 319.1–319.9, 304, 312/306, 307, 21–30, 223.2, 234.44–334.47; 108/144.11, 145–148; 62/407; 188/171, 188/161, 163, 322.5; 192/143, 144; 310/77, 310/93, 94; 74/49, 50, 55, 53, 411.5, 89.17, 74/422

See application file for complete search history.

(56) References Cited

U.S. PATENT DOCUMENTS 869,735 A * 10/1907 Rubin ..... 312/334.32
2,497,734 A * 2/1950 Kuklich ..... 312/312
2,614,020 A * 10/1952 Collins ..... 312/312
2,769,676 A * 11/1956 Larsen et al. ..... 312/306
3,246,939 A 4/1966 Petkwitz et al.
3,658,394 A * 4/1972 Gutner ..... 384/21
3,982,801 A * 9/1976 Heidorn et al. ..... 312/306
4,002,385 A * 1/1977 Hone ..... 312/286
4,121,878 A * 10/1978 Lokken ..... 312/334.45
4,288,137 A * 9/1981 MacDonald ..... 312/334.45

(Continued)

FOREIGN PATENT DOCUMENTS

DE 297 01 227 U1 6/1997

(Continued)

*Primary Examiner*—Lanna Mai
*Assistant Examiner*—Timothy M Ayres
(74) *Attorney, Agent, or Firm*—Birch, Stewart, Kolasch & Birch, LLP

(57) ABSTRACT

A refrigerator having a basket lift apparatus comprises: a body having cooling chambers for storing food; a basket arranged at the lower cooling chamber arranged at a lower portion of the body to be movable back and forth, and having a door at a front side thereof; a lifting frame arranged at a rear surface of the door to be movable up and down and on which the basket is placed; a driving arm roll-motioned at a lower surface of the lifting frame and hinge-connected to the door, for lifting the lifting frame; a driving unit for rotating the driving arm; and a locking unit installed at the lifting frame, for maintaining a lifted state of the basket by locking the driving arm when the lifting frame is lifted up.

7 Claims, 8 Drawing Sheets

U.S. PATENT DOCUMENTS

| | | | | | |
|---|---|---|---|---|---|
| 4,420,197 | A | * | 12/1983 | Dreiling | 312/334.41 |
| 4,568,132 | A | * | 2/1986 | Watt | 312/312 |
| 4,790,611 | A | * | 12/1988 | Craner | 312/306 |
| 5,429,043 | A | * | 7/1995 | Becker | 99/448 |
| 5,580,174 | A | * | 12/1996 | Houck | 384/19 |
| 5,586,816 | A | | 12/1996 | Geiss, II et al. | |
| 2004/0100168 | A1 | | 5/2004 | Choi | |
| 2004/0119388 | A1 | * | 6/2004 | Huang | 312/334.44 |
| 2005/0073225 | A1 | | 4/2005 | Kwon et al. | |

FOREIGN PATENT DOCUMENTS

| | | | |
|---|---|---|---|
| JP | 05-296647 | A | 11/1993 |
| KR | 100159711 | B1 | 8/1998 |
| KR | 10-2004-0065760 | A | 7/2004 |
| WO | WO-01/71263 | | 9/2001 |

* cited by examiner

REFRIGERATOR HAVING BASKET LIFT APPARATUS

BACKGROUND OF THE INVENTION

1. Field of the Invention

The present invention relates to a refrigerator having a basket lift apparatus, and more particularly, to a refrigerator having a basket lift apparatus capable of enhancing a user's convenience by lifting up a basket arranged at a lower portion of a body.

2. Description of the Conventional Art

FIG. 1 is a perspective view showing a refrigerator in accordance with the conventional art, and FIG. 2 is a sectional view of a lower region of a refrigerator showing a state that a basket is accommodated in a body.

The conventional refrigerator comprises: a body 102 having an opened front side and an accommodation space; an upper cooling chamber 106 arranged at an upper side of the body 102 and having a pair of upper doors 104 opened to both sides, for storing food; and a lower cooling chamber 112 arranged at a lower side of the body 102, separated from the upper cooling chamber 106 by a partition wall 108, and having a lower door 110 opened by a slidable manner.

A mechanical chamber 116 having a compressor 114 for generating cold air to be supplied to the upper cooling chamber 106 and the lower cooling chamber 112, etc. is installed at a rear side of the body 102.

A basket 120 for accommodating freezing items is arranged at the lower cooling chamber 112 to be slidable back and forth, and the lower door 110 is fixed at a front side of the basket 120. According to this, when the lower door 110 is pulled, the basket 120 is opened, and when the lower door 110 is pushed, the basket 120 is closed. A guide rail 124 is installed between an inner side surface of the basket 120 and an inner side surface of the lower cooling chamber 112, thereby guiding the basket 120 to be slidable back and forth.

A plurality of drawers for storing food are installed at an upper side of the basket 120 to be opened in a slidable manner.

In the conventional refrigerator, when a user forwardly pulls the lower door 110 in order to take out the food stored in the lower cooling chamber 112 or in order to accommodate food in the lower cooling chamber 112, the basket 120 is opened with a slide motion. Also, the when the user backwardly pushes the lower door 110 after taking out the food stored in the basket 120 or accommodating food in the basket 120, the basket 120 is closed with a slide motion.

However, in the conventional refrigerator, since the basket is arranged at a lower portion of the refrigerator, the user has to bend his or her waist or has to crouch in order to take out the food stored in the basket or to accommodate food in the basket thereby to have inconvenience in using the basket.

SUMMARY OF THE INVENTION

Therefore, an object of the present invention is to provide a refrigerator having a basket lift apparatus capable of enhancing a user's convenience by elevating a position of a basket by lifting the basket when the basket arranged at a lower portion of a body is drawn out of a lower cooling chamber.

Another object of the present invention is to provide a refrigerator having a basket lift apparatus capable of stably fixing a basket by supporting a lifted state of the basket.

To achieve these and other advantages and in accordance with the purpose of the present invention, as embodied and broadly described herein, there is provided a refrigerator having a basket lift apparatus comprising: a body having cooling chambers for storing food; a basket arranged at the lower cooling chamber arranged at a lower portion of the body to be movable back and forth, and having a door at a front side thereof; a lifting frame arranged at a rear surface of the door to be movable up and down and on which the basket is placed; a driving arm roll-motioned at a lower surface of the lifting frame and hinge-connected to the door, for lifting the lifting frame; a driving unit for rotating the driving arm; and a locking unit installed at the lifting frame, for maintaining a lifted state of the basket by locking the driving arm when the lifting frame is lifted up.

The locking unit is constructed as a locking protrusion formed at a lower surface of the lifting frame and mounted at one end of the driving arm, for locking a roller roll-motioned at the lifting frame so that the roller can not be moved in a direction that the lifting frame is descended.

The locking protrusion is composed of: a guide inclination surface having a certain angle in a direction that the lifting frame is lifted up and guiding a motion of the roller; and a locking portion formed at the end of the guide inclination surface as a right angle and locking the roller.

A curved surface portion is roundly formed at a part that the locking portion meets the guide inclination surface so that the roller can be separated from the locking unit and can be moved when the driving motor is backwardly driven.

The locking portion of the locking protrusion has a height enough to maintain a locked state of the roller against a load that food is accommodated in the basket to the maximum.

The locking unit is constructed as a locking groove formed at a lower surface of the lifting frame and locking the roller mounted at the end of the driving arm.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, a refrigerator having a basket lift apparatus will be explained in more detail with reference to the attached drawings.

Even if there may exist a plurality of preferred embodiments of the refrigerator having a basket lift apparatus according to the present invention, the most preferred embodiment will be explained hereinafter.

Figure 1:
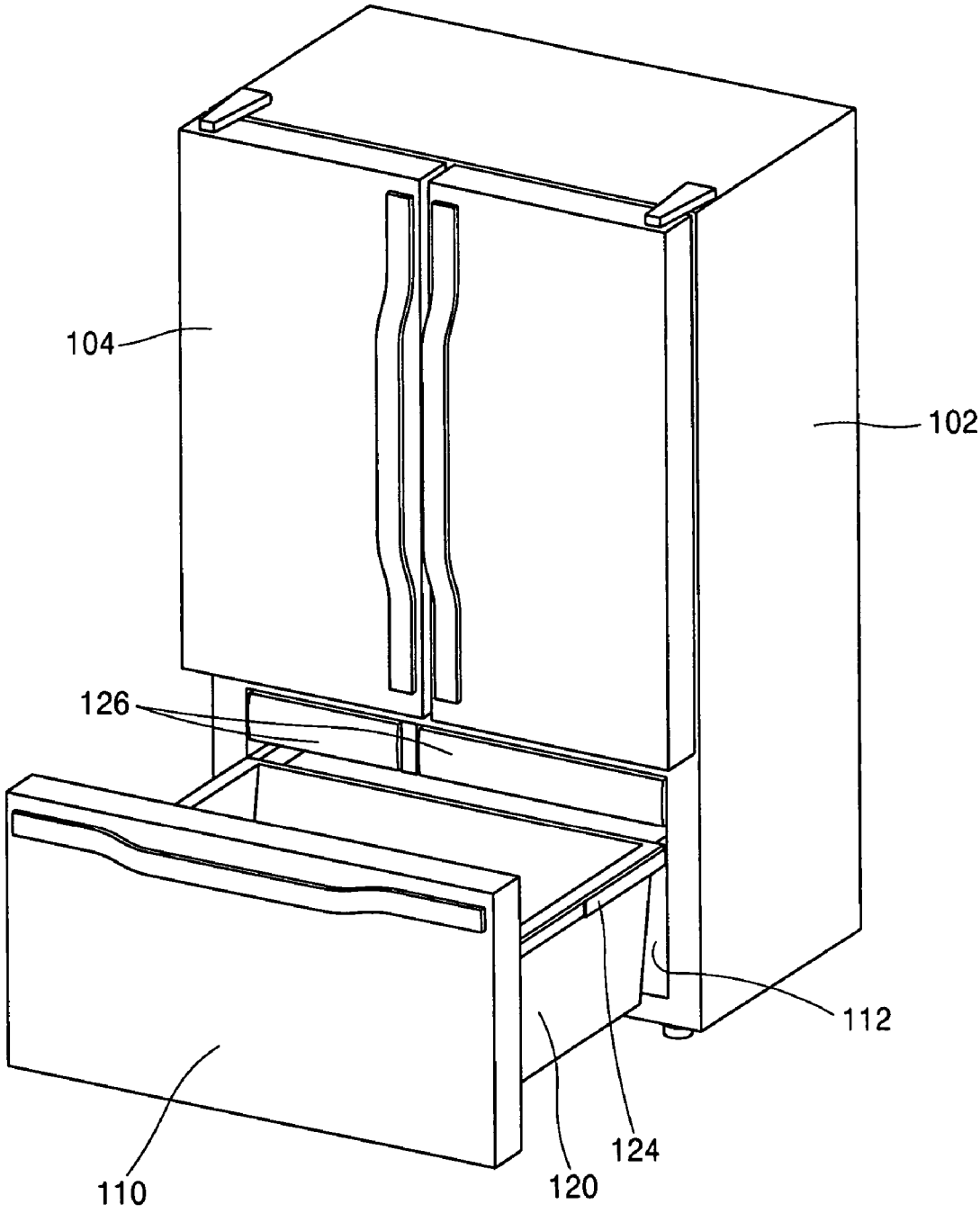
FIG. 1 CONVENTIONAL ART
FIG. 1 is a perspective view showing a refrigerator in accordance with the conventional art.
Figure 2:
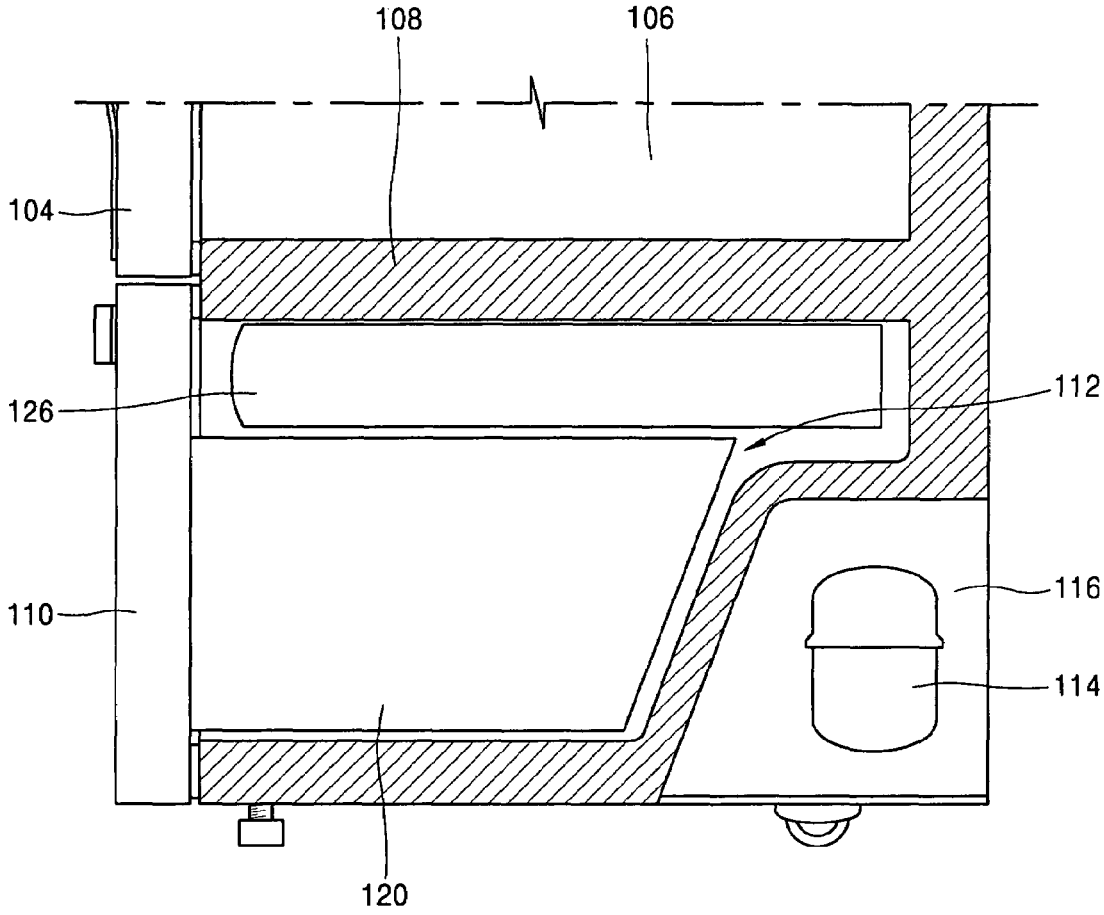
FIG. 2 CONVENTIONAL ART
FIG. 2 is a section view showing a lower region of the refrigerator in accordance with the conventional art.
Figure 3:
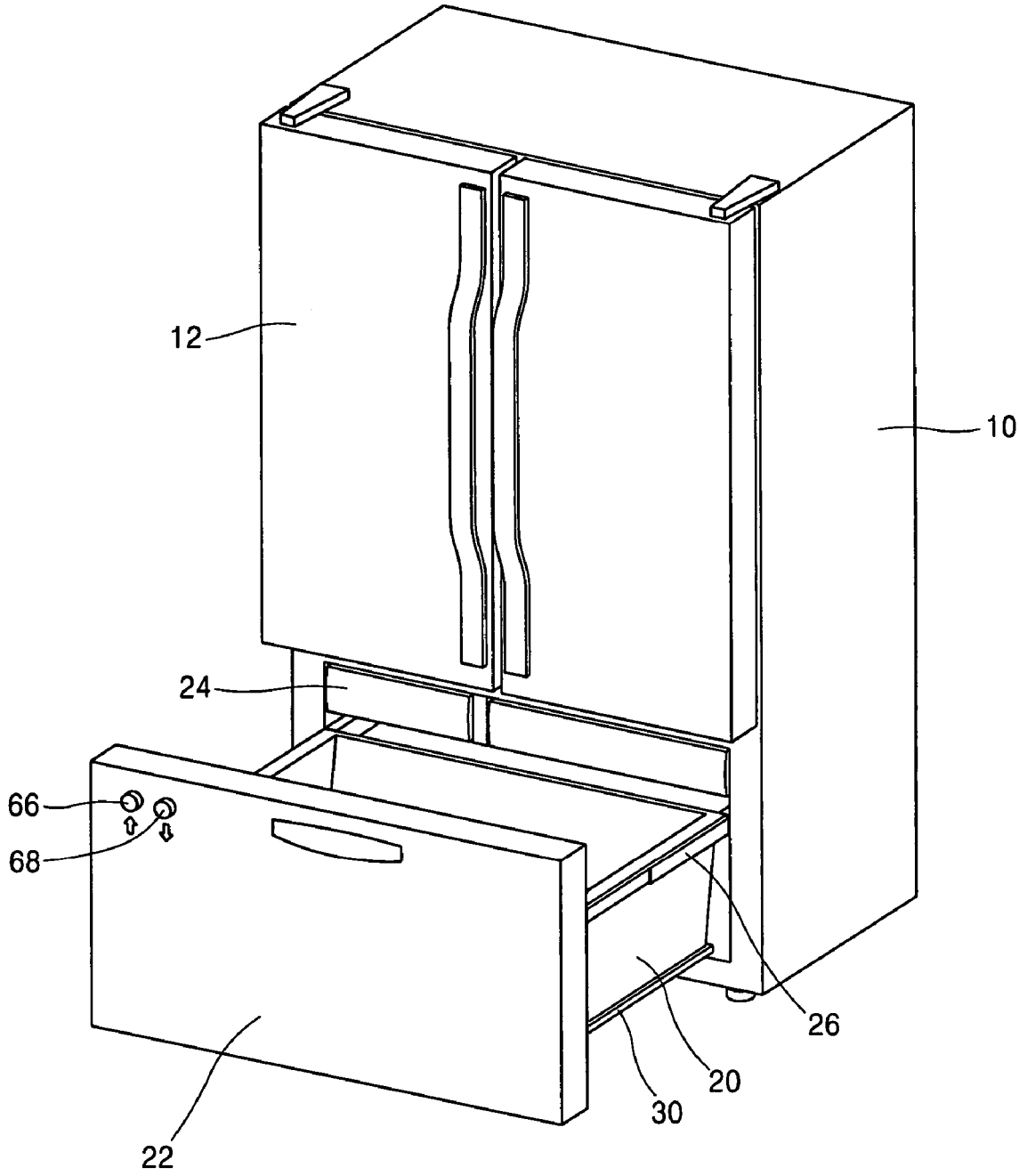
FIG. 3 is a perspective view showing a refrigerator according to the present invention.
Figure 4:
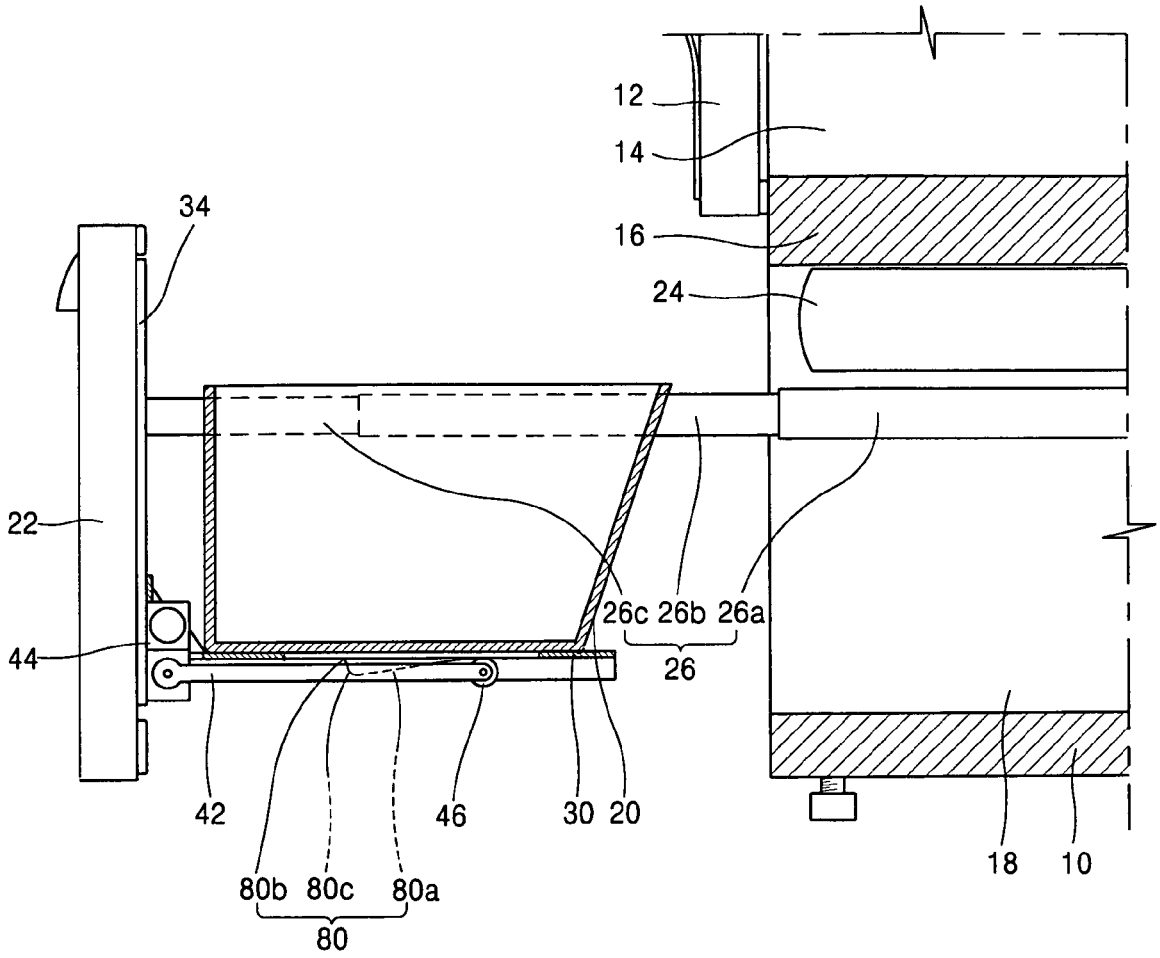
FIG. 4 is a section view of a basket lift apparatus of a refrigerator according to one embodiment of the present invention.

FIG. 3 is a perspective view of a refrigerator according to the present invention, and FIG. 4 is a sectional view showing a basket lift apparatus of the refrigerator according to the present invention.

A refrigerator according to the present invention comprises: a body 10 having an accommodation space; an upper cooling chamber 14 arranged at an upper portion of the body 10 and having a pair of upper doors 12 opened to both sides; a lower cooling chamber 18 separated from the upper cooling chamber 14 by a partition wall 16 and arranged at a lower portion of the body 10; a basket 20 arranged at the lower cooling chamber 18 to be slidable back and forth, for storing food; and a lifting unit for lifting the basket 20 up.

Preferably, the upper cooling chamber 14 is used a cooling chamber for storing refrigerating food items, and the lower cooling chamber 18 is used as a freezing chamber for storing freezing food items.

A lower door 22 for pushing the basket 20 or drawing the basket 20 out of the lower cooling chamber 18 along back and forth directions of the body 10 is arranged at a front side of the lower cooling chamber 18. A plurality of drawers 24 drawn out along back and forth directions of the body 10 and for storing food are installed at an upper side of the lower cooling chamber 18.

A pair of guide rails 26 are installed between both lateral surfaces of the lower cooling chamber 18 and a rear surface of the lower door 22, thereby guiding the lower door 22 from being slid in back and forth directions of the body 10.

The guide rail 26 is composed of: a fixed rail 26*a* fixed at both lateral surfaces of the lower cooling chamber 18; a middle rail 26*b* slidably connected to the fixed rail 26*a*; and a movable rail 26*c* slidably connected to the middle rail 26*b* and fixed to a rear surface of the lower door 22.

Figure 5:
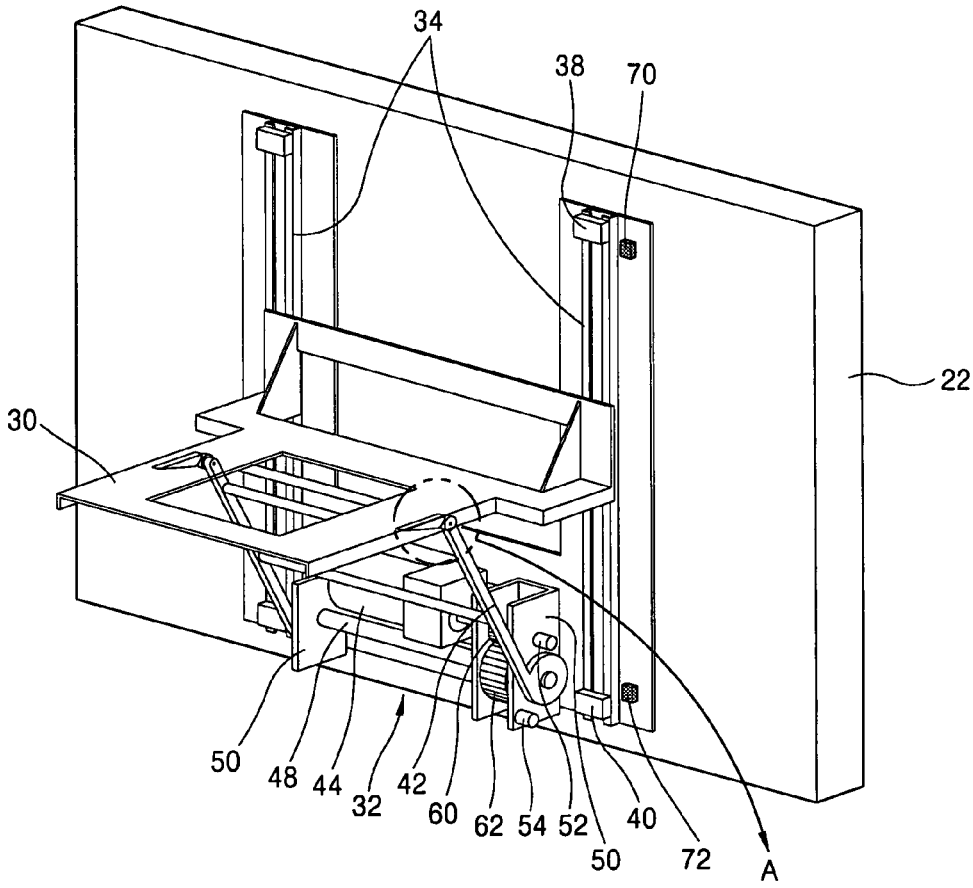
FIG. 5 is a perspective view of the basket lift apparatus of a refrigerator according to one embodiment of the present invention.
Figure 6:
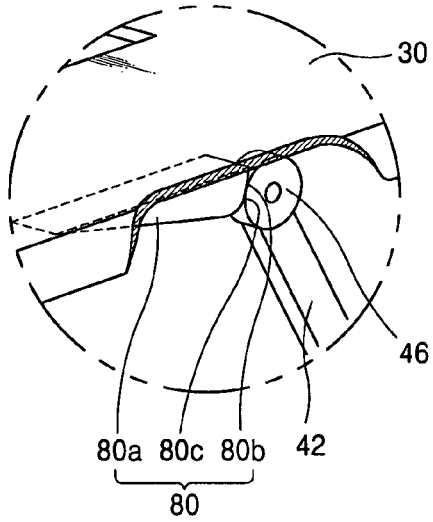
FIG. 6 is an enlargement view of 'A' part of FIG. 5.
Figure 7:
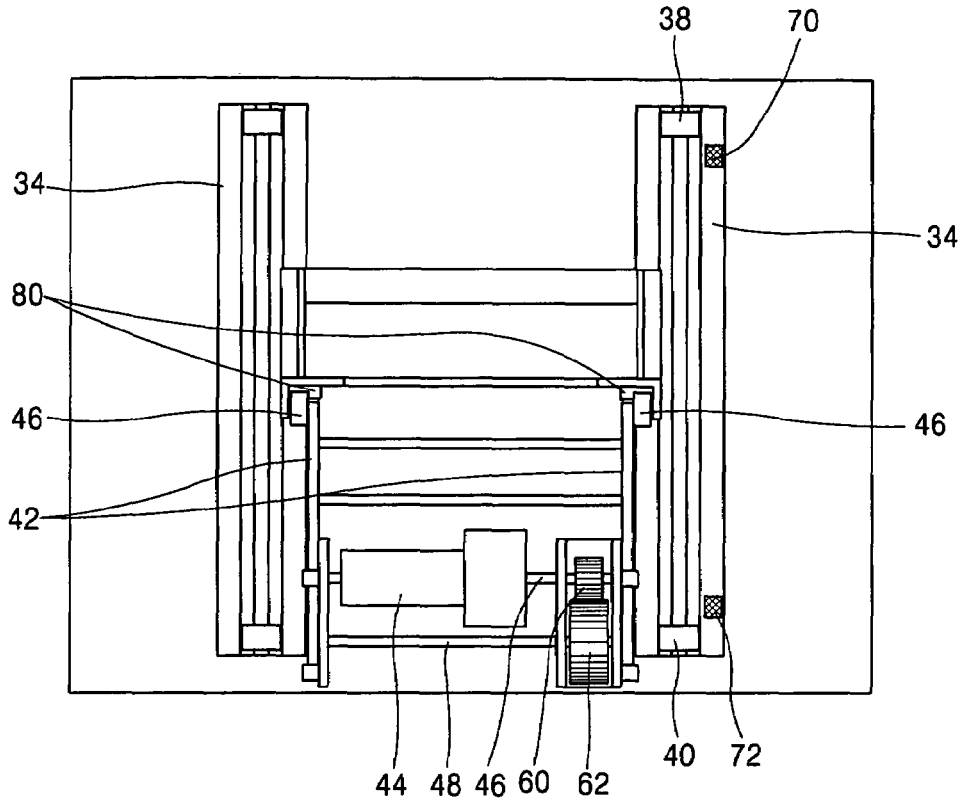
FIG. 7 is a frontal view of the basket lift apparatus of a refrigerator according to one embodiment of the present invention.

As shown in FIGS. 5, 6, and 7, the lifting unit is composed of: a lifting frame 30 arranged at a rear surface of the lower door 22 to be movable up and down and on which the basket 20 is placed; a driving arm 42 roll-motioned at a lower surface of the lifting frame 30 and hinge-connected to the lower door 22, for lifting the lifting frame 30; a driving unit 32 for rotating the driving arm 42; a locking unit installed at the lifting frame 30, for maintaining a lifted state of the basket 20 by locking the driving arm 42 when the lifting frame 30 is lifted up; and a control unit for controlling the driving unit 32 and thereby lifting the basket 20 when the basket 20 is drawn out.

The lifting frame 30 is formed as a flat plate type on which the basket 20 is placed, and one side surface of the lifting frame 30 is curved as a right angle thus to be mounted at a rear surface of the lower door 22 to be movable up and down.

A pair of lifting rails 34 are vertically fixed to the rear surface of the lower door 22, and the lifting frame 30 is mounted at the lifting rail 34 to be slidable up and down. As best seen in FIG. 7, a distance between the connection of the lifting frame 30 to the lifting rails 34 measured in a lateral direction of the lower door 22 is greater than a distance between the pair of driving arms 42 measured in the lateral direction of the lower door 22.

An upper stopper 38 and a lower stopper 40 are respectively mounted at an upper end and a lower end of the lifting rail 34, thereby preventing the lifting frame 30 from being separated from the lower door 22.

A roller 46 roll-motioned at a lower surface of the lifting frame 30 is mounted at one end of the driving arm 42, and a hinge shaft 48 is mounted at another end of the driving arm 42. The hinge shaft 48 is rotatably supported by a supporting frame 50 fixed to the rear surface of the lower door 22.

A first stopper 52 and a second stopper 54 for limiting a rotation range of the driving arm 42 are respectively formed at a lateral surface of the supporting frame 50.

The driving unit 32 is composed of: a driving motor 44 fixed to the rear surface of the lower door 22, for rotating the driving arm 42 and thereby lifting the lifting frame 30; and a power transmitting unit for transmitting a rotation force generated from the driving motor 44 to the driving arm 42.

The power transmitting unit is composed of: a driving gear 60 fixed to a rotational shaft 47 of the driving motor 44 and arranged in the supporting frame 50; and a driven gear 62 fixed to the hinge shaft 48 and gear-engaged with the driving gear 60.

The locking unit is for locking the roller 46 mounted at one end of the driving arm 42 so that the roller 46 can not be roll-motioned in a direction that the lifting frame 30 is descended. The locking unit is preferably constructed as a locking protrusion 80 formed at a lower surface of the lifting frame 30.

The locking protrusion 80 is composed of: a guide inclination surface 80*a* having a certain angle in a direction that the lifting frame 30 is lifted up guiding a motion of the roller 46; and a locking portion 80*b* formed at the end of the guide inclination surface 80*a* as a right angle, for locking the roller 46 and thereby preventing the roller 46 from being backwardly moved.

A curved surface portion 80*c* is roundly formed at a part that the locking portion 80*b* meets the guide inclination surface 80*a* so that the roller 46 can be separated from the locking portion 80*b* and can be moved when the driving motor 44 is backwardly driven.

The locking portion 80*b* of the locking protrusion 80 has a height enough to maintain a locked state of the roller 46 against a load that food is accommodated in the basket 20 positioned on the lifting frame 30 to the maximum when the driving motor 44 is stopped.

Preferably, the locking portion 80*b* of the locking protrusion 80 has a height enough for the roller 46 to be separated from the locking portion 80*b* and to be backwardly moved when the driving motor 44 is backwardly driven.

Figure 8:
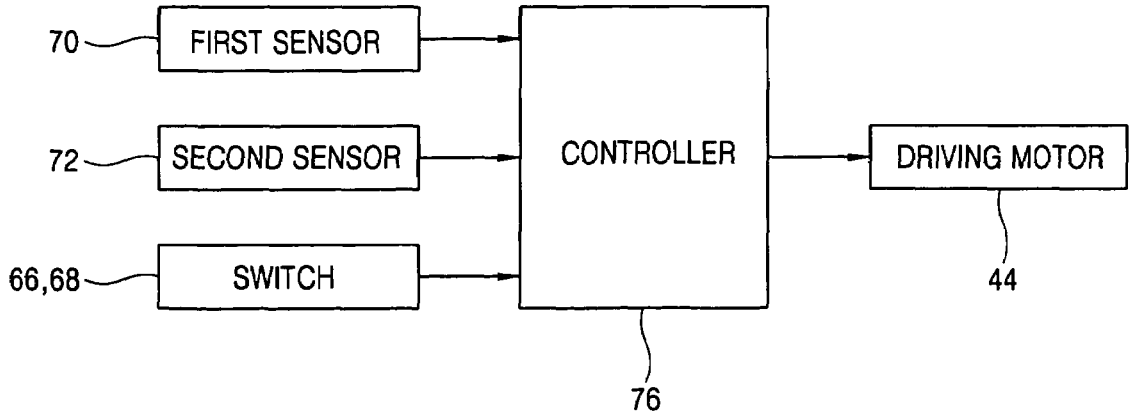
FIG. 8 is a block diagram showing a control unit of the basket lift apparatus of a refrigerator according to one embodiment of the present invention.

As shown in FIG. 8, the control unit for driving the driving motor 44 forwardly or backwardly by a user's adjustment is composed of: switches 66 and 68 adjusted by a user; a first sensor 70 mounted at an upper end of the lifting rail 34, for sensing a state that the lifting frame 30 is lifted to the maximum; a second sensor 72 mounted at a lower end of the lifting rail 34, for sensing a state that the lifting frame 30 is descended to the maximum; and a controller 76 for controlling the driving motor 44 according to a signal applied from the switches 66 and 68, the first sensor 70, and the second sensor 72.

The switches are composed of: a first switch 66 mounted at a front surface of the lower door 22 and adjusted by the user when the lifting frame 30 is to be lifted; and a second switch 68 adjusted by the user when the lifting frame 30 is to be descended.

The first sensor 70 and the second sensor 72 are preferably are constructed as a limit switch for applying a signal to the controller 76 at the time of being contact with the lifting frame 30 or the basket 20 positioned on the lifting frame 30, or are constructed as an optical sensor.

An operation of the basket lift apparatus according to the present invention will be explained as follows.

Figure 9:
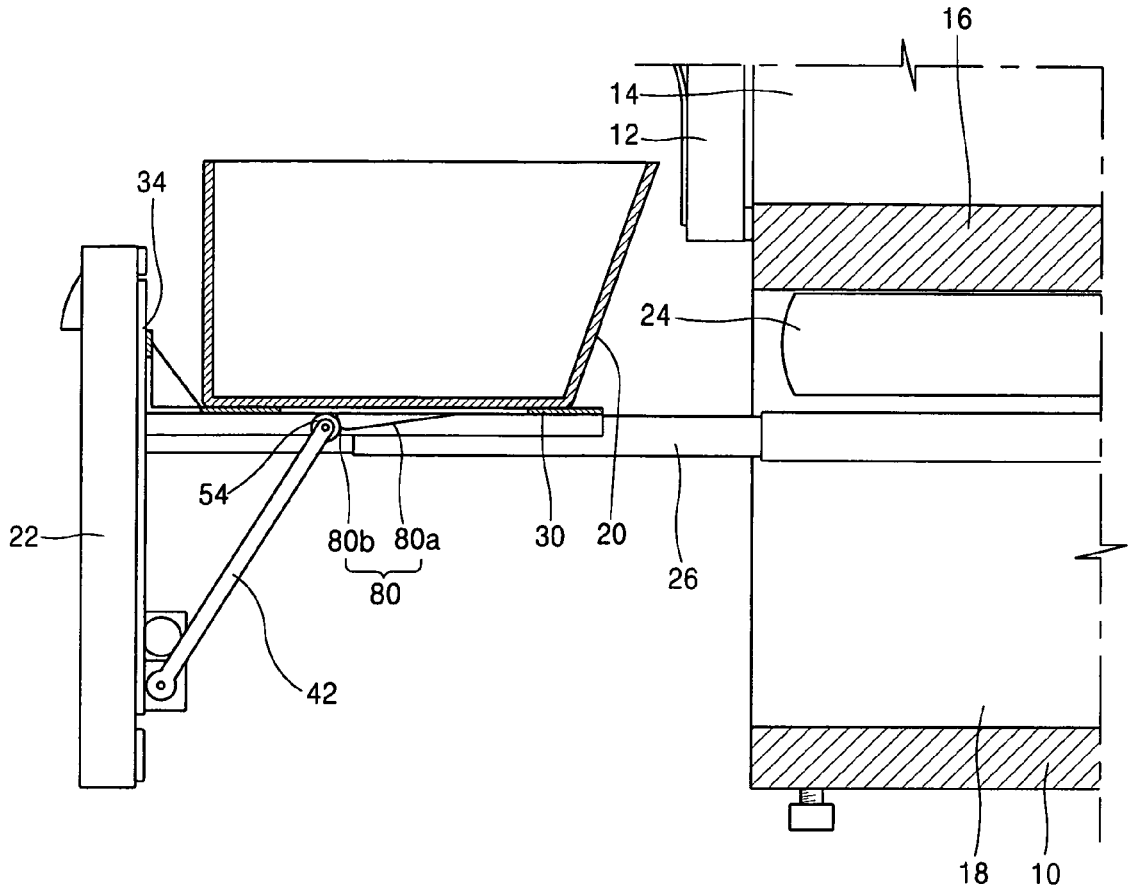
FIG. 9 is an operation state view of the basket lift apparatus of a refrigerator according to one embodiment of the present invention.

FIG. 9 is a lateral view showing a state that the basket lift apparatus is lifted according to one embodiment of the present invention.

The user forwardly pulls the lower door 22 in order to take out food stored in the basket 20 thereby to draw the basket 20 out of the lower cooling chamber 18, and then adjusts the first switch 66 mounted at the front surface of the lower door 22. According to this, a signal is applied to the controller 76 from the first switch 66, and the controller 76 drives the driving motor 44 in a forward direction.

According to this, the rotational shaft 47 of the driving motor 44 is rotated thus to rotate the driving gear 60 fixed to the rotational shaft 47, and thereby the driven gear 62 gear-engaged with the driving gear 60 is rotated thus to rotate the hinge shaft 48. According to this, another end of the driving arm 42 fixed to the hinge shaft 48 is rotated and thereby the roller 46 mounted at one end of the driving arm 42 is roll-motioned at a lower surface of the lifting frame 30 thus to lift the lifting frame 30. When the lifting frame 30 is lifted to the maximum, the first sensor 70 senses the maximum lifted state of the lifting frame 30 thus to apply the signal to the controller 75. Then, the controller 76 stops the driving motor 44.

At this time, the roller 46 is moved along the guide inclination surface 80*a* of the locking protrusion 80 formed at a lower surface of the lifting frame 30. When the lifting frame 30 is lifted to the maximum, the roller 46 is locked by the locking portion 80*b* of the locking protrusion 80. According to this, the roller 46 is prevented from being backwardly moved even when the driving motor 44 is stopped, thereby maintaining the lifted state of the basket 20.

When the basket 20 is lifted, the driving motor 44 is stopped by a signal applied from the first sensor 70 and the basket 20 is descended by a dead weight. Accordingly as the basket 20 is descended, the driving motor 44 is driven again thereby to lift the basket 20. Accordingly as the driving motor 44 is turned on/off repeatedly, a trembling phenomenon of the basket 20 is generated and the lifted state of the basket 20 can not be stably maintained. However, the lifted state of the basket 20 can be more stably maintained by the locking unit.

If the user adjusts the second switch 68 after taking out food stored in the basket 20, the controller 76 backwardly drives the driving motor 44 thereby to descend the lifting frame 30.

When the driving motor 44 is backwardly driven, the roller 46 is detached from the locking portion 80*b* of the locking protrusion 80 thereby to be backwardly moved and thereby the lifting frame 30 is descended.

When the descent of the lifting frame 30 is completed, the second sensor 72 senses the descended state of the lifting frame 30 thereby to apply the sensed signal to the controller 76. Then, the controller 76 stops the operation of the driving motor 44. Also, when the user pushes the lower door 22 backwardly, the basket 20 is accommodated in the lower cooling chamber 18.

Figure 10:
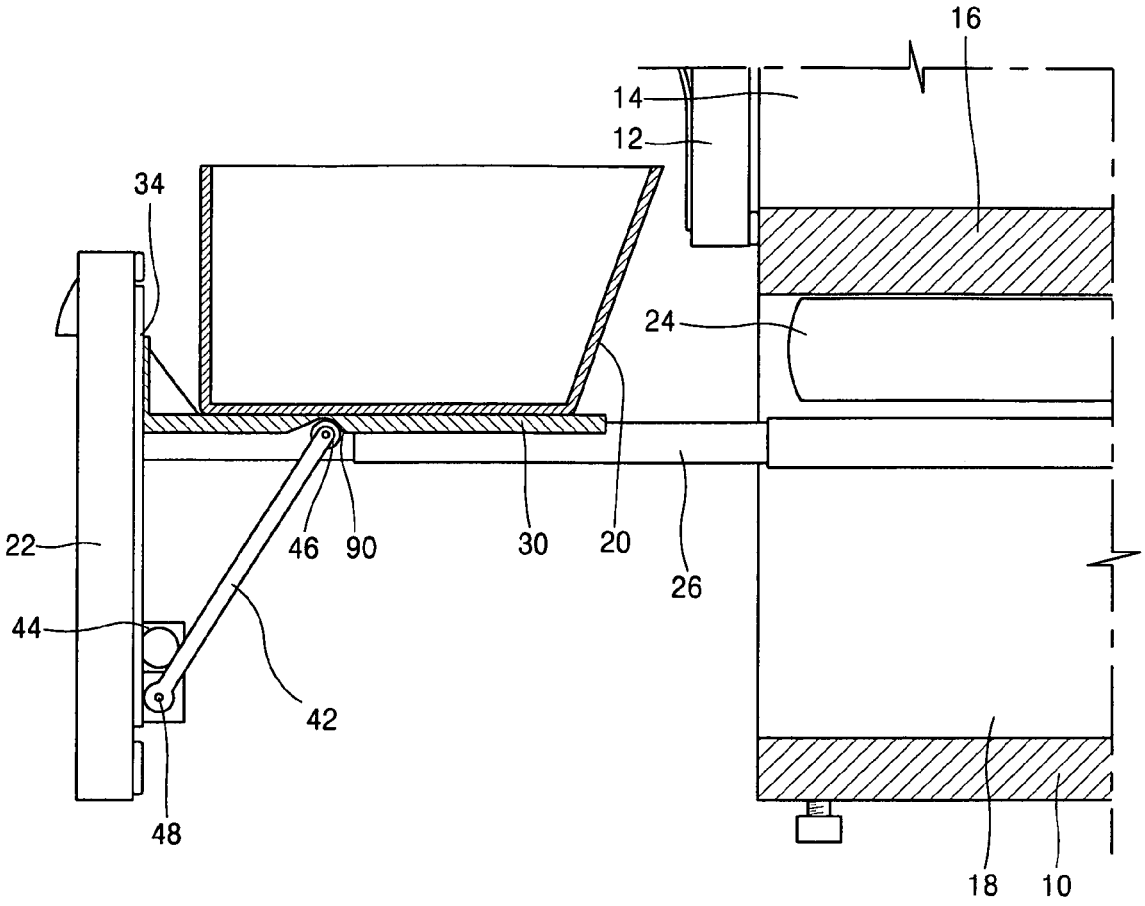
FIG. 10 is a section view of a basket lift apparatus according to a second embodiment of the present invention.

FIG. 10 is a sectional view showing a basket lift apparatus according to a second embodiment of the present invention.

The basket lift apparatus according to the second embodiment is the same as the basket lift apparatus aforementioned in the first embodiment except a structure of a locking unit for maintaining a lifted state of the basket.

That is, the locking unit according to the second embodiment is constructed as a locking groove 90 formed at a lower surface of the lifting frame and locking the roller.

The locking groove 90 preferably has a depth enough to maintain a locked state of the roller 46 in the locking groove 90 even against a load of the basket 20 positioned on the lifting frame 30 where food is stored to the maximum when the driving motor 44 is stopped.

Also, the locking groove 90 preferably has a depth enough for the roller 46 to be detached from the locking groove 90 and thus to be backwardly moved when the driving motor 44 is backwardly driven.

Effects of the basket lift apparatus according to the present invention will be explained as follows.

When the basket is drawn out of the lower cooling chamber, the basket is lifted by using the basket lift apparatus. According to this, the user can take out food stored in the basket without bending his or her waist thereby to enhance the user's convenience.

Also, when the basket is lifted to the maximum, the maximum lifted state of the basket is fixed by using the locking unit installed at a lower surface of the lifting frame. According to this, the trembling phenomenon of the basket due to a repetitive on/off of the driving motor is prevented, and the lifted state of the basket can be more stably maintained.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A refrigerator comprising:

a body having a cooling chamber;

a basket received in the cooling chamber and having a door at a front side thereof;

a pair of lifting rails connected to the door;

a lifting frame movably connected to each of the pair of lifting rails, and on which the basket is positioned;

a pair of driving arms, each driving arm being provided with a roller roll-motioned at a lower surface of the lifting frame at one end thereof, the pair of driving arms being connected by a hinge shaft extending therebetween, the hinge shaft being rotatably mounted at the door; and a driving unit mounted at the door to rotate the pair of driving arms; and a locking unit for locking the pair of driving arms when the lifting frame is lifted and thereby for maintaining a lifted position of the basket, wherein the locking unit is a locking protrusion formed at a lower surface of the lifting frame for stopping the roller roll-motioned at the lower surface of the lifting frame when the lifting frame is lifted to the maximum, and wherein a distance between connections of the lifting frame to the pair of lifting rails measured in a lateral direction of the door is greater than a distance between the pair of driving arms measured in the lateral direction of the door.

2. The refrigerator of claim 1, wherein the driving unit comprises:

a driving motor fixed to the door for generating a driving force; and a power transmitting unit installed between the driving motor and the hinge shaft to which the pair of driving arms is hinge-connected for transmitting a rotation force generated from the driving motor to the pair of driving arms.

3. The refrigerator of claim 1, wherein the locking protrusion comprises:

a guide inclination surface formed with a certain angle in a direction that the lifting frame is lifted for moving the roller; and a locking unit that an end of the guide inclination surface is formed as a right angle for locking the roller.

4. The refrigerator of claim 3, wherein a curved portion roundly formed for detaching the roller from the locking unit and moving the roller when the driving motor is backward driven is formed at an intersection point between the locking unit and the guide inclination surface.

5. The refrigerator of claim 3, wherein the locking unit of the locking protrusion has a height enough to maintain a locked state of the roller even under a load of the basket in which food is stored to the maximum.

6. The refrigerator of claim 1, further comprising a driving unit for controlling the driving unit according to a user's adjustment and thereby lifting the basket.

7. The refrigerator of claim 6, wherein the control unit comprises:

a switch adjusted by a user;

a first sensor mounted at an upper end of the door for sensing a position that the lifting frame is lifted to the maximum;

a second sensor mounted at a lower end of the door for sensing a position that the lifting basket is descended to the maximum; and a controller for controlling the driving motor according to a signal applied from the switch, the first sensor,; and the second sensor.

* * * * *